United States Patent [19]

Shaw et al.

[11] 4,455,920

[45] Jun. 26, 1984

[54] ROCKER CAM CONTROL

[75] Inventors: Edwin L. Shaw, Delaware; Alan H. Viles, Columbus, both of Ohio

[73] Assignee: Abex Corporation, Stamford, Conn.

[21] Appl. No.: 383,679

[22] Filed: Jun. 1, 1982

[51] Int. Cl.[3] ..... F01B 13/04; F01B 25/00

[52] U.S. Cl. ..... 92/12.2; 91/505

[58] Field of Search ..... 91/504–506; 92/137, 12.2; 417/218, 222

[56] References Cited

U.S. PATENT DOCUMENTS 3,053,187 9/1962 Washinter ..... 92/137

3,396,670 8/1968 Baits ..... 91/506

FOREIGN PATENT DOCUMENTS 3000921 7/1981 Fed. Rep. of Germany ..... 91/505

823626 4/1981 U.S.S.R. ..... 91/505

*Primary Examiner*—William L. Freeh

*Attorney, Agent, or Firm*—Thomas S. Baker, Jr.

[57] ABSTRACT

A variable displacement, rocker cam type, axial piston pump in which the rocker cam is driven by a stroking piston and the stroking piston is connected to the rocker cam by a pair of flexible connectors and tension in the first flexible connector is raised and tension in the second flexible connector is lowered when the stroking piston is moved in one direction to pivot the rocker cam toward a position of maximum fluid displacement and tension in the second flexible connector is raised and tension in the first flexible connector is lowered when the stroking piston is moved in the other direction to pivot the rocker cam toward a position of minimum fluid displacement.

4 Claims, 4 Drawing Figures

ROCKER CAM CONTROL

BACKGROUND OF THE INVENTION

This invention relates to a variable displacement axial piston pump in which a thrust plate is mounted on a rocker cam which is received in a rocker cradle and is pivoted in the cradle by a stroking piston to change the displacement of the pump. More particularly, this invention relates to a means for connecting the stroking piston to the rocker cam.

In a variable displacement axial piston pump in which a thrust plate is mounted on a rocker cam, the rocker cam is pivoted in a rocker cradle to change the displacement of the pump. Typically, the rocker cam rotates about an axis normal to the axis of rotation of the pump cylinder barrel. A fluid motor is commonly used to drive the rocker cam. One type of fluid motor is a hydraulic stroking piston and cylinder. The stroking piston is connected to the rocker cam such that linear displacement of the piston results in rotary displacement of the rocker cam.

One means of connecting a hydraulic stroking piston to a rocker cam is shown in U.S. Pat. No. 3,803,987 which is assigned to the assignee of the instant invention. In that device a control arm is rigidly affixed to the rocker cam and projects rearwardly beyond the curved cam surface which is partially received in a rocker cradle. The distal end of the control arm is bifurcated and receives a pin mounted in the central portion of a stroking piston. Linear motion of the stroking piston causes the cam to rotate in the rocker cradle. A problem with this type of mechanical connection between the stroking piston and the rocker cam is that relative movement between the rocker cam and stroking piston can occur because of the tolerances and clearances which are necessary to enable assembly of the parts and to enable the parts to move relative to each other. A particular problem with a piston pump is that when the unit is operating the center of pressure moves. This causes the load on parts such as the pin and arm to change and results in wear of this joint. As the amount of wear increases, the amount of backlash or lost motion between the pin and arm increases. This makes precise positioning of the rocker cam by the stroking piston difficult.

It is possible to eliminate some of the backlash in the type of structure described above by having a spring-loaded piston bear against one side of the control arm and a hydraulically operated stroking piston act against the other side of the control arm. A problem with this structure is that wear still occurs at the interface of the piston and the control arm.

It is desirable to provide a variable displacement, rocker cam type, axial piston pump with a connection between a stroking piston and the rocker cam which has no lost motion and in which wear of the parts at the interface of the cam and the stroking piston is eliminated.

It is also desirable to provide a variable displacement, rocker cam type, axial piston pump with a connection between the stroking piston and the rocker cam which is easy to assemble and relatively inexpensive.

SUMMARY OF THE INVENTION

The instant invention provides a variable displacement, rocker cam type, axial piston pump in which the rocker cam is driven by a stroking piston and the stroking piston is connected to the rocker cam by a flexible connecting means. The flexible connecting means includes a pair of flexible connectors attached to the rocker cam and the stroking piston and the rocker cam is pivoted toward a position of maximum fluid displacement when the stroking piston is moved in one direction and toward a position of minimum fluid displacement when the stroking piston is moved in the other direction.

DESCRIPTION OF THE PREFERRED EMBODIMENT

Figure 1:
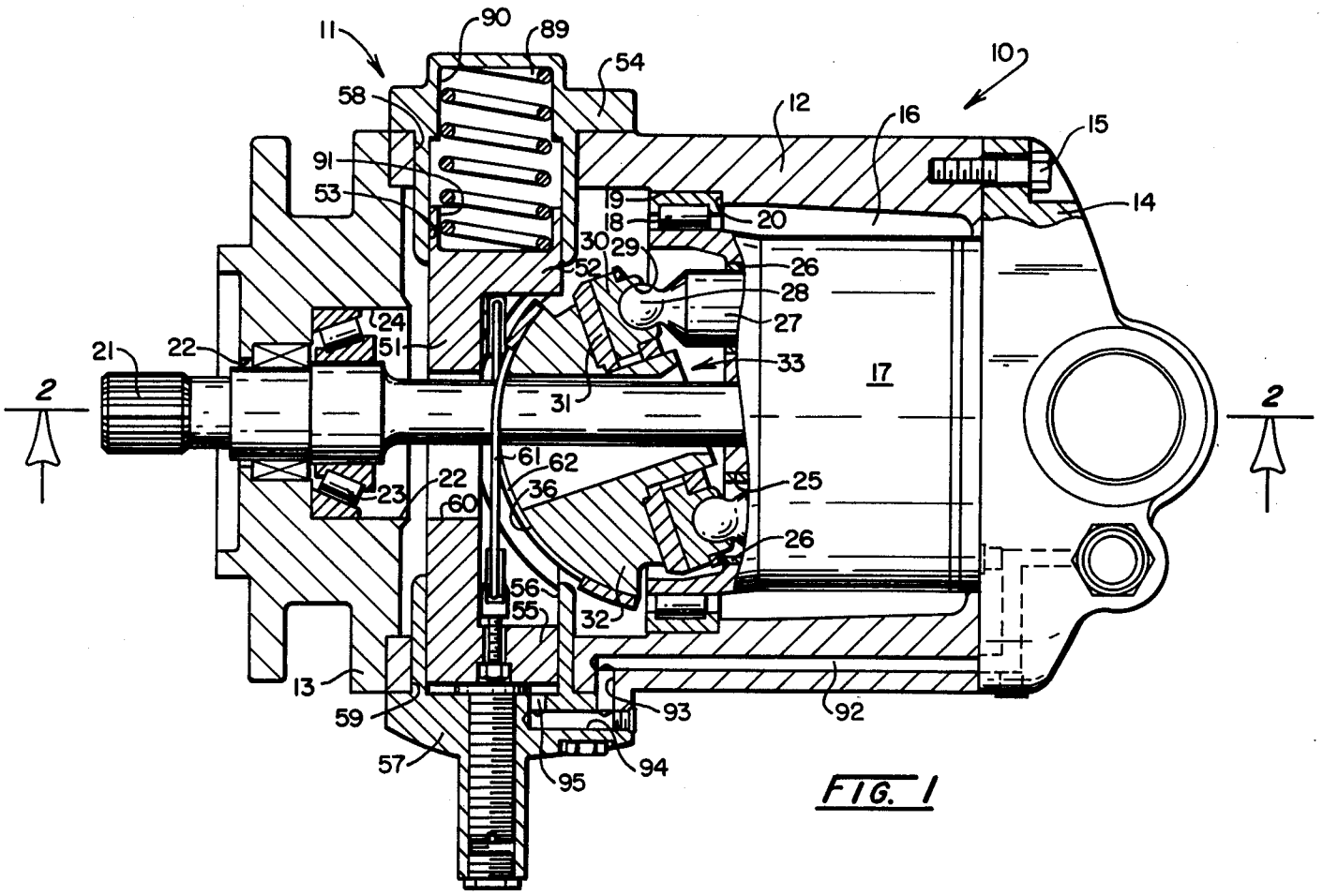
FIG. 1 is an axial sectional view of a pump constructed in accordance with the subject invention.
Figure 2:
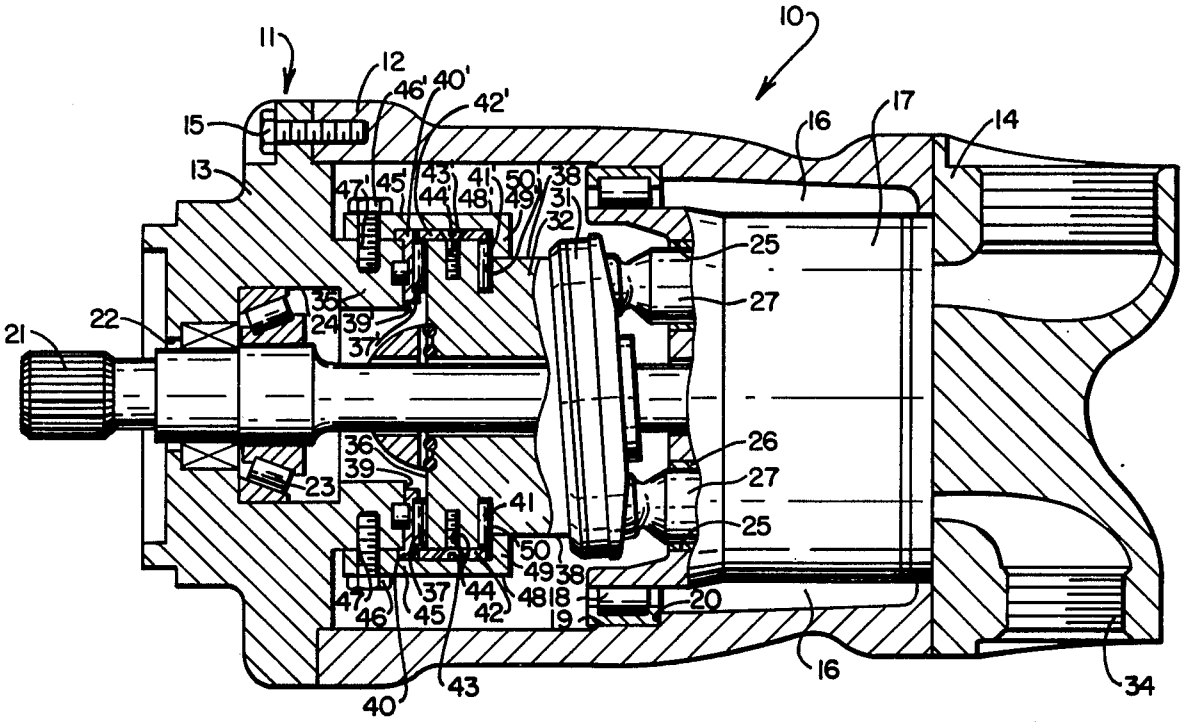
FIG. 2 is a part axial sectional view along line 2—2 of FIG. 1.

Referring to FIGS. 1 and 2, an axial piston pump 10 has a case 11 which includes a central housing 12, an end cap 13 at one end and a port cap 14 at the other end. Case 11 is fastened together by bolts 15.

Central housing 12 has a cavity 16 in which a rotatable cylinder barrel 17 is mounted in a roller bearing 18. Roller bearing 18 is pressed into a bore 19 in housing 12 and seated against a shoulder 20. A splined drive shaft 21 passes through a bore 22 in end cap 13 and has one end which engages a splined central bore (not shown) in barrel 17. Drive shaft 21 is supported near its other end in a roller bearing 23 mounted in a bore 24 in end cap 13.

Barrel 17 has a plurality of bores 25 equally spaced circumferentially about its rotational axis. A sleeve 26 in each bore 25 receives a piston 27. Each piston 27 has a spherical head 28 which is received in a socket 29 of a shoe 30. Each shoe 30 is retained against the surface of a flat thrust plate 31 mounted on a movable rocker cam 32 by a shoe retainer assembly 33. One such assembly is described in U.S. Pat. No. 3,898,917, which is assigned to the assignee of the instant invention.

Rotation of the drive shaft 21 by a prime mover, such as an electric motor (not shown), will rotate barrel 17. If rocker cam 32 and thrust plate 31 are inclined from a neutral or centered (minimum displacement) position, normal to the axis of shaft 21, the pistons 27 will reciprocate as the shoes 30 slide over the surface of thrust plate 31. As the pistons 27 move outward of barrel 17 toward rocker cam 32, as viewed in FIG. 1, low pressure fluid is received in sleeves 26. As the pistons move inward in barrel 17 toward port cap 14, they expel high pressure fluid into an exhaust port 34. Pump displacement increases as the inclination of thrust plate 31 increases.

Figure 3:
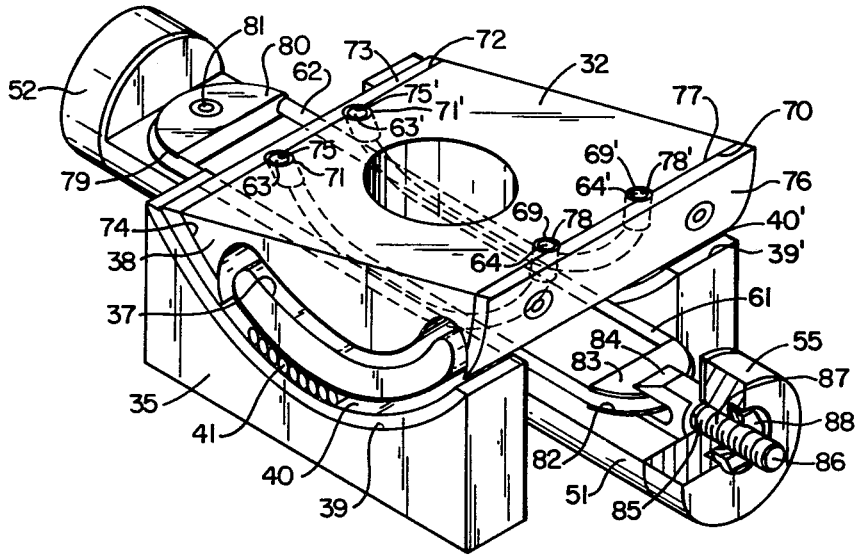
FIG. 3 is a perspective view showing the stroking piston, the rocker cam and cradle assembly and the flexible connectors which connect the rocker cam to the stroking piston.

Since thrust plate 31 is mounted on rocker cam 32 the angular position of thrust plate 31 is determined by the angular position of rocker cam 32. Rocker cam 32 is pivotally mounted on a rocker cradle 35 as will next be described. Rocker cam 32 has a convex, arcuate, rear surface 36 opposite the surface of thrust plate 31. A continuous, kidney-shaped roller surface 37, 37′ is formed on each side 38, 38′ of rocker cam 32 with arcuate surface 36 therebetween, as shown in FIGS. 2 and 3. The outer portions of the roller surfaces 37, 37′ on the back of rocker cam 32 are substantially parallel to arcuate surface 36.

Rocker cradle 35 is rigidly secured to end cap 13 and has a pair of concave, arcuate surfaces 39, 39' formed thereon which are complementary with the outer portion of the rocker cam roller surfaces 37, 37'. A hardened bearing element 40, 40' is inserted on each rocker cradle surface 39, 39', respectively. A complement of rollers 41, 41' is inserted around each roller surface 37, 37', respectively, and a portion of each roller complement 41, 41' engages one of the bearing elements 40, 40'. Since the roller surfaces 37, 37' are continuous, the rollers in the complements 41, 41' are free to recirculate.

The rollers in the roller complements 41, 41' are penetrated from moving laterally by a pair of side plates 42, 42', shown in FIG. 2. These side plates 42, 42' are mounted on the sides 38, 38' of rocker cam 32 by bolts 43, 43' which are received in threaded bores 44, 44' in cam 32.

Rocker cam 32 and roller complements 41, 41' are retained in contact with bearing elements 40, 40' on rocker cradle 35 by a pair of holddown plates 45, 45' which resist forces tending to lift rocker cam 32 from cradle 35. Holddown plates 45, 45' are rigidly secured to rocker cradle 35 by bolts 46, 46' which are received in threaded bores 47, 47' in cradle 35. The holddown plates 45, 45' have long sides 48, 48' which overlie and extend beyond the side plates 42, 42', respectively. The sides 48, 48' terminate in short lateral legs 49, 49'. Each leg 49, 49' overlies the portion of the roller complement 41, 41' which lies on the inner portion of the arcuate roller surface 37, 37' facing thrust plate 31. The inner surfaces 50, 50' of the lateral legs 49, 49' are complementary to the inner portion of the roller surfaces 37, 37' and engage the rollers thereon to provide a roller bearing support for engagement of the rocker cam 32 with the holddown plates 45, 45'. From the above, it can be seen that the rocker cam 32 is provided with a roller bearing support on rocker cradle 35. Further, a roller bearing support is provided for rocker cam 32 on the holddown plates 45, 45' to resist forces tending to lift the cam 32 from the rocker cradle 35.

The mechanism for pivoting rocker cam 32 with respect to rocker cradle 35 will next be described. A stroking piston 51 has one end 52 received in an inner bore 53 of a stroking cylinder 54 and the other end 55 received in the inner bore 56 of a stroking cylinder 57. The stroking cylinders 54, 57 are mounted in a pair of aligned bores 58, 59, respectively, formed in central housing 12. These bores 58, 59 are aligned normal to the longitudinal axis of drive shaft 21. A central bore 60 is formed in stroking piston 51 to permit the drive shaft 21 to pass through the piston 51. Also, the center portion of stroking piston 51 is cut away to receive the rear portion of rocker cam 32 containing arcuate surface 36. This permits rear surface 36 to be aligned with the longitudinal axis of the stroking piston 51.

Figure 4:
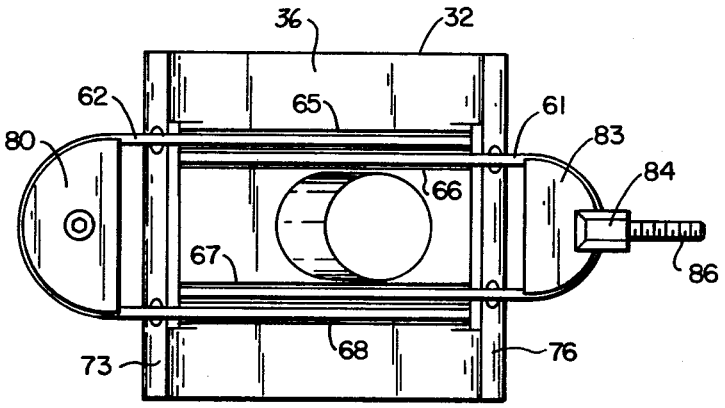
FIG. 4 is a view of the back side of the rocker cam.

Stroking piston 51 is connected to rocker cam 32 by a pair of flexible connectors 61, 62. The connectors 61, 62 are cables constructed of multiple strands of wire and each has a cylindrical ferrule 63, 63', 64, 64' swaged onto both of its ends. Referring to FIGS. 3 and 4, rocker cam 32 has four parallel grooves 65, 66, 67, 68 formed in rear arcuate surface 36. One pair of grooves 65, 68 terminates in semi-cylindrical indentations 69, 69', respectively, adjacent one rocker cam edge 70 and the other pair of grooves 66, 67 terminates in semi-cylindrical indentations 71, 71' adjacent the opposite edge 72 of rocker cam 32. One-half of each ferrule 63, 63' at the end of flexible connector 61 is received in a semi-cylindrical indentation 71, 71'. Similarly, one-half of each ferrule 64, 64' at the end of flexible connector 62 is received in a semi-cylindrical indentation 69, 69'.

A retainer plate 73 with a curved inner surface 74 which matches the curvature of the back surface 36 of rocker cam 32 is affixed to the back of rocker cam 32 by bolts, not shown, such that it overlies the ends of connector 61. A pair of semi-cylindrical indentations 75, 75' are formed in retainer plate surface 74 opposite the indentations 71, 71' formed in cam surface 36 such that the ferrules 63, 63' at each end of connector 61 are securely clamped between the retainer plate 73 and the rocker cam 32. A second retainer plate 76 with a curved inner surface 77 is affixed to the back of rocker cam 32 such that it overlies the ends of connector 62. Likewise, retainer surface 77 has a pair of semi-cylindrical indentations 78, 78' formed therein opposite indentations 69, 69' in cam surface 36 such that ferrules 64, 64' at each end of connector 62 are securely clamped between the retainer plate 76 and the rocker cam 32. Thus, the ends of the flexible connectors 61, 62 are rigidly secured and prevented from moving in the grooves 65–68.

The flexible connectors 61, 62 are attached to the stroking piston 51 as follows. Flexible connector 62 lies in a groove 79 formed in the outer edge of a semi-circular anchor 80. Anchor 80 is rigidly affixed to end 52 of stroking piston 51 by a bolt 81. Likewise, flexible connector 61 lies in a groove 82 formed in the outer edge of a semi-circular anchor 83. Anchor 83 is connected to end 55 of stroking piston 51 by a yoke 84 which overlies groove 82 and has a threaded central bore 85. A bolt 86 passes through a longitudinal bore 87 in end 55 and engages yoke bore 85. A nut 88 is threaded onto the outer end of bolt 86. Nut 88 is rotated to tension both connectors 61 and 62 simultaneously to remove slack therein and to eliminate free play between rocker cam 32 and stroking piston 51. Consequently, rocker cam 32 pivots when stroking piston 51 is displaced.

Referring to FIG. 1, a spring 89 received in a bore 90 in stroking cylinder 54 and a bore 91 in end 52 of stroking piston 51 acts to bias the stroking piston 51 downward until the opposite end 55 reaches the end of bore 56 in stroking cylinder 57. In this position the rocker cam 32 is at its greatest inclination and the pump 10 is set for maximum fluid displacement.

Rocker cam 32 is at a position of minimum fluid displacement when the surface of thrust plate 31 is normal to the axis of rotation of barrel 17. In order to pivot cam 32 in rocker cradle 35 out of the position of maximum fluid displacement, pressure fluid must be supplied to stroking cylinder 57 to bias stroking piston 51 upwardly against the force of spring 89. That pressure fluid is supplied from the outlet of pump 10 to passages 92, 93 in central housing 12 and passages 94, 95 in stroking cylinder 57 to piston bore 56. Fluid in bore 56 acts on the end 55 of stroking piston 51 and biases it upwardly against the force of spring 89. As stroking piston 51 moves upwardly, the flexible connector 62 is placed in increased tension and rocker cam 32 is forced to pivot in rocker cradle 35. As previously mentioned, nut 88 is tightened to eliminate slack in the flexible connectors 61, 62. Thus, both connectors 61, 62 are pretensioned. When stroking piston 51 is moved upwardly, tension in flexible connector 62 is increased and tension in flexible connector 61 is decreased. Conversely, when the pressure of the fluid in the stroking cylinder bore 56 drops and spring 89 moves stroking piston 51 downward, tension in flexible connector 61 is increased and tension in flexible connector 62 is decreased.

Although the connectors 61, 62 are flexible laterally in order to accommodate bending around the outer surface of the anchors 80, 82 and to accommodate bending in the grooves 65–68 in rocker cam surface 63, the connectors 61, 62 do not stretch longitudinally. Additionally, since the rear surfacd 36 of rocker cam 32 is aligned with the longitudinal axis of stroking piston 51, the flexible connectors 61, 62 are likewise aligned with the longitudinal axis of stroking piston 51.

From the above it can be seen that the flexible connectors 61, 62 provide a connection between stroking piston 51 and rocker cam 32 which can be adjusted to eliminate backlash and which has no mechanical joints to wear.

Although a preferred embodiment of the invention has been illustrated and described, it will be apparent to those skilled in the art that various modifications may be made without departing from the spirit and scope of the present invention.

What is claimed is:

1. A variable displacement fluid energy translating device having a housing, a barrel rotatably supported in the housing, a plurality of cylinders formed in the barrel and aligned parallel with the axis of rotation thereof, a piston mounted for reciprocation in each cylinder, a shoe connected to the end of a piston projecting from each cylinder, a rocker cradle, a first arcuate surface formed on the rocker cradle, a rocker cam, a second arcuate surface formed on the rocker cam adjacent and complementary to the first arcuate surface, means for pivotally supporting the rocker cam on the first arcuate surface for movement about an axis perpendicular to the axis of rotation of the barrel, a flat thrust surface on the rocker cam on which the piston shoes slide, means for retaining the shoes against the thrust surface such that the pistons reciprocate within the cylinders when the cam surface is inclined and the barrel is rotated, a stroking piston mounted for reciprocation in the housing, and characterized by means for connecting the stroking piston to the rocker cam including a first flexible connector attached to the rocker cam and to the stroking piston and a second flexible connector attached to the rocker cam and to the stroking piston, wherein tension in the first flexible connector is raised and tension in the second flexible connector is lowered when the stroking piston is moved in one direction and the rocker cam is pivoted toward a position of maximum fluid displacement and tension in the second flexible connector is raised and tension in the first flexible connector is lowered when the stroking piston is moved in the other direction and the rocker cam is pivoted toward a position of minimum fluid displacement, and two pairs of grooves formed in the second arcuate surface of the rocker cam, and a portion of the first flexible connector is received in the first pair of grooves and a portion of the second flexible connector is received in the second pair of grooves.

2. The variable displacement fluid energy translating device of claim 1, characterized by a first pair of indentations formed in the second arcuate surface at one end of the first pair of grooves, a second pair of indentations formed in the second arcuate surface at the end of the second pair of grooves opposite the first pair of indentations, a portion of the ends of the first flexible connector being each received in one of the first pair of indentations, a portion of the ends of the second flexible connector being each received in one of the second pair of indentations, a first retaining plate which overlies the ends of the first flexible connector and is attached to the second arcuate surface of the rocker cam to secure the first connector ends in the first pair of indentations and a second retaining plate which overlies the ends of the second flexible connector and is attached to the second arcuate surface of the rocker cam to secure the second connector in the second pair of indentations.

3. A variable displacement fluid energy translating device having a housing, a barrel rotatably supported in the housing, a plurality of cylinders formed in the barrel and aligned parallel with the axis of rotation thereof, a piston mounted for reciprocation in each cylinder, a shoe connected to the end of a piston projecting from each cylinder, a rocker cradle, a first arcuate surface formed on the rocker cradle, a rocker cam, a second arcuate surface formed on the rocker cam adjacent and complementary to the first arcuate surface, means for pivotally supporting the rocker cam on the first arcuate surface for movement about an axis perpendicular to the axis of rotation of the barrel, a flat thrust surface on the rocker cam on which the piston shoes slide, means for retaining the shoes against the thrust surface such that the pistons reciprocate within the cylinders when the cam surface is inclined and the barrel is rotated, a stroking piston mounted for reciprocation in the housing, and characterized by means for connecting the stroking piston to the rocker cam including a first flexible connector attached to the rocker cam and to the stroking piston and a second flexible connector attached to the rocker cam and to the stroking piston, wherein tension in the first flexible connector is raised and tension in the second flexible connector is lowered when the stroking piston is moved in one direction and the rocker cam is pivoted toward a position of maximum fluid displacement and tension in the second flexible connector is raised and tension in the first flexible connector is lowered when the stroking piston is moved in the other direction and the rocker cam is pivoted toward a position of minimum fluid displacement, the connecting means further including a first anchor mounted on one end of the stroking piston for attaching the first flexible connector to the one end of the stroking piston, and a second anchor mounted on the other end of the stroking piston for attaching the second flexible connector to the other end of the stroking piston, two pairs of grooves formed in the second arcuate surface of the rocker cam, and the ends of the first flexible connector are received in the first pair of grooves and the ends of the second flexible connector are received in the second pair of grooves and the second arcuate surface of the rocker cam is aligned with the longitudinal axis of the stroking piston such that the intermediate portions of the first and second connectors between the first and second anchors and the second arcuate surface of the rocker cam are aligned with the longitudinal axis of the stroking piston.

4. A variable displacement fluid energy translating device having a housing, a barrel rotatably supported in the housing, a plurality of cylinders formed in the barrel and aligned parallel with the axis of rotation thereof, a piston mounted for reciprocation in each cylinder, a shoe connected to the end of a piston projecting from each cylinder, a rocker cradle, a first arcuate surface formed on the rocker cradle, a rocker cam, a second arcuate surface formed on the rocker cam adjacent and complementary to the first arcuate surface, means for pivotally supporting the rocker cam on the first arcuate surface for movement about an axis perpendicular to the axis of rotation of the barrel, a flat thrust surface on the rocker cam on which the piston shoes slide, means for retaining the shoes against the thrust surface such that the pistons reciproate within the cylinders when the cam surface is inclined and the barrel is rotated, a stroking piston mounted for reciprocation in the housing, and characterized by means for connecting the stroking piston to the rocker cam including a first flexible connector attached to one edge of the rocker cam and to the stroking piston and a second flexible connector attached to the other edge of the rocker cam and to the stroking piston, and wherein tension in the first flexible connector is raised and tension in the second flexible connector is lowered when the stroking piston is moved in one direction and the rocker cam is pivoted toward a position of maximum fluid displacement and tension in the second flexible connector is raised and tension in the first flexible connector is lowered when the stroking piston is moved in the other direction and the rocker cam is pivoted toward a position of minimum fluid displacement, the connecting means further including a first anchor mounted on one end of the stroking piston for attaching the first flexible connector to the one end of the stroking piston and a second anchor mounted on the other end of the stroking piston for attaching the second flexible connector to the other end of the stroking piston, means for simultaneously setting the amount of pretension in the first and second flexible connectors and said setting means being connected to the stroking piston.

* * * * *